US008973681B2

(12) United States Patent
Aros

(10) Patent No.: US 8,973,681 B2
(45) Date of Patent: Mar. 10, 2015

(54) PRESSURIZED FLUID FLOW SYSTEM FOR A REVERSE CIRCULATION DOWN-THE-HOLE HAMMER AND HAMMER THEREOF

(75) Inventor: Jaime Andrés Aros, Santiago (CL)

(73) Assignee: Drillco Tools S.A., Santiago (CL)

( * ) Notice: Subject to any disclaimer, the term of this patent is extended or adjusted under 35 U.S.C. 154(b) by 370 days.

(21) Appl. No.: 13/413,072

(22) Filed: Mar. 6, 2012

(65) Prior Publication Data

US 2013/0233626 A1 Sep. 12, 2013

(51) Int. Cl.
*E21B 4/14* (2006.01)

(52) U.S. Cl.
USPC ..... 175/296; 175/293; 175/414

(58) Field of Classification Search
CPC ..... E21B 4/14; E21B 4/06; E21B 21/00
USPC ..... 175/296, 293, 414, 417, 212, 65
See application file for complete search history.

(56) References Cited

U.S. PATENT DOCUMENTS 7,467,675 B2 * 12/2008 Lay ..... 175/296
2009/0188723 A1 * 7/2009 Aros ..... 175/296

* cited by examiner

*Primary Examiner* — David Andrews
*Assistant Examiner* — Ronald Runyan
(74) *Attorney, Agent, or Firm* — Ladas & Parry LLP

(57) ABSTRACT

A pressurized fluid flow system for a reverse circulation down-the-hole hammer includes a cylinder and a cylindrical control tube that are respectively coaxially disposed in between the outer casing and the piston of the hammer and in between the piston and the sample tube. Two chambers help to respectively supply and discharge pressurized fluid into and out of the front and rear chambers that exert work on the piston: an internal chamber, defined by a central recess in the inner surfaces of the piston and permanently connected to the source of pressurized fluid, and a discharge chamber, defined by one or more recesses in the inner surface of the outer casing and permanently communicated with the bottom of the hole. A hammer provided with this system has one or more end discharge ports connected to respective longitudinal discharge channels formed on the outer surface of the outer casing.

7 Claims, 4 Drawing Sheets

PRESSURIZED FLUID FLOW SYSTEM FOR A REVERSE CIRCULATION DOWN-THE-HOLE HAMMER AND HAMMER THEREOF

FIELD OF APPLICATION OF THE INVENTION

The present invention generally relates to a pressurized fluid flow system for a percussive mechanism operating with said fluid, particularly for a DTH (Down-The-Hole) hammer and more particularly for a reverse circulation DTH hammer, and to a DTH hammer with said system.

STATE OF THE ART

DTH hammers that operate with pressurized fluid are characterized by comprising a cylindrical outer casing, a rear sub for connecting the hammer to the source of pressurized fluid, a drill bit at its foremost end to perform the drilling function and a piston that effects a reciprocating movement due to the change in pressure of the pressurized fluid contained in two main work chambers, a front chamber and a rear chamber, formed inside the hammer and located at opposite ends of the piston, said reciprocating movement of the piston allowing to transfer the energy from the pressurized fluid to the rock with each impact of the piston on the drill bit.

The hammer's thermodynamic cycle develops in accordance with the piston's reciprocating movement from the point of its stroke in which the piston is in contact with the drill bit (known as impact position) up to the rearmost point of its stroke, the latter dependent on the hammer's operation. Accordingly, as the piston moves, the front and rear chambers are alternatively and cyclically supplied with pressurized fluid, discharged of the same, or subject to an expansion or compression process, the latter depending on the direction of the piston's movement and the chamber being tightly sealed, thus causing the volume enclosed within the chamber to respectively increase or decrease. The transition from one state to the other is independent for each chamber and is controlled by the position of the piston with respect to other parts of the hammer in such a way that the piston acts in itself as a valve, as well as an impact element.

In reverse circulation drilling a double walled rod is used, that is formed by two concentric pipes, an inner pipe or sampling tube and an outer pipe. An extension of said sampling tube is provided along the center of the hammer, from the drill bit to the rear sub, forming a continuous central passage along the center of the hammer for enabling to recover the rock cuttings and soil samples and convey these to the ground surface through the center of the drill string.

The hammer may be operated in two modes. In the first one, or drilling mode, pressurized fluid is supplied to the hammer producing the reciprocating movement of the piston which at the end of each cycle impacts the drill bit, the front end of the drill bit thereby performing the function of drilling the rock and rock cuttings being exhausted to the ground surface by the pressurized fluid discharged to the bottom of the hole. In the second one, or flushing mode, the drill string and the hammer are lifted by the drill rig in such a way that the drill bit loses contact with the rock, and all the pressurized fluid is discharged through the hammer directly to the bottom of the hole for cleaning purposes, without passing through the hammer cycle, thus ceasing the reciprocating movement of the piston.

There are many different types of reverse circulation DTH hammers available for drilling and sample recovering. Three methods are commonly used for controlling the supply of pressurized fluid to the front and rear chambers: 1) use of a fluid passageway formed between the outer surface of a cylinder and inner surface of the outer casing, the cylinder being mounted inside the outer casing coaxial with the piston; 2) use of a supply chamber formed within the outer casing that interacts with recesses in the outer sliding surfaces of the piston and passages in the outer casing as the piston reciprocates; and 3) use of a feed tube to create a supply chamber inside the piston, wherein this feed tube interacts with recesses in the inner or central bore-side surfaces of the piston as the piston reciprocates. On the other hand, the discharge of pressurized fluid from the front chamber is commonly controlled by either a foot valve mounted in the drill bit or a front portion of the piston of smaller diameter interacting with a piston guide. Similarly, the discharge of pressurized fluid from the rear chamber is commonly controlled by either an air guide placed on the rear part of the rear chamber or by the front end of the feed tube.

Generally to convey the pressurized fluid from the rear end of the drill bit to the front end of the same some channels are created in the outer surface of the drill bit that cooperatively work with splines on the inner surface of the driver sub and with a ring or sleeve acting as sealing element so as to form enclosed passages in such a manner as to discharge the pressurized fluid to the periphery of the front end of the drill bit. The pressurized fluid may also be deviated from an intermediate point in the drill bit through bores in the driver sub to a passage formed between the outer surface of the driver sub and the inner surface of the sealing ring. Alternatively, the pressurized fluid may be deviated from said intermediate point through longitudinal bores created on the head of the drill bit.

One type of reverse circulation DTH hammer that offers a new way of controlling the supply of pressurized fluid to the front and rear chambers and of discharging the pressurized fluid from them is disclosed in U.S. Pat. No. 7,921,941 (B2). Specifically, a cylinder is coaxially disposed in between the outer casing and the piston, and a supply chamber is disposed longitudinally in series with a discharge chamber, wherein both chambers are defined by respective recesses in the inner surface of the outer casing and internally delimited by the outer surface of the cylinder, and are separated by a dividing wall. The supply chamber is permanently connected to the source of pressurized fluid for supplying said fluid to the front chamber and rear chambers of the hammer, while the discharge chamber is permanently communicated with the bottom of the hole for discharging the pressurized fluid from the front and rear chambers. A set of fluid conducting means is provided in the piston for channeling the flow of pressurized fluid from the supply chamber to the front and rear chambers and out of said chambers. In a second embodiment of the '941 patent an internal chamber is provided in between the piston and the sampling tube for a more efficient filling of the chambers. The internal chamber is defined by a recess in the inner surfaces of the piston and is permanently connected to the supply chamber.

In said same patent, to discharge the pressurized fluid from the discharge chamber and convey it to the peripheral region of the front end of the drill bit, end discharge ports are provided in the front end portion of the outer casing. These end discharge ports are aligned with respective longitudinal channels formed along the outer surface of the outer casing. Further, both the end discharge ports and longitudinal channels are covered by a shroud or outer sealing sleeve.

The control of the flow of pressurized fluid in and out of the front and rear chambers is thus simplified and thanks to the use of "blind" passages in the piston the thrust areas in the piston are maximized for better transfer of energy to the rock, hence improving the deep drilling capacity of the hammer. Also, a simpler and sturdier bit design is provided as opposed to other known reverse circulation DTH hammers where discharge of pressurized fluid to the bottom of the hole is achieved by more centrally located fluid-conducting means.

In spite of the above-mentioned advantages of the '941 patent, it would be desirable to combine them with the following improvements:

providing a structurally simpler pressurized fluid flow system and hammer that could reduce manufacturing costs; and providing a sturdier piston in order for the hammer to operate at a higher pressure and deliver higher energy to the rock without the risk of a catastrophic failure of the piston.

BRIEF SUMMARY OF THE INVENTION

In a first aspect of the invention, a pressurized fluid flow system has been developed for a reverse circulation DTH hammer having a cylindrical outer casing, a rear sub affixed to the rear end of the casing and connected to the source of pressurized fluid, a centrally-bored piston slidably and coaxially disposed inside the outer casing, a drill bit slidably mounted in the front end of the hammer on a driver sub and a sample tube coaxially disposed within the outer casing, passing through the central bore of the piston and extending from the rear sub to the drill bit, wherein the pressurized fluid flow system comprises:

a cylinder coaxially disposed in between the outer casing and the piston, the cylinder extending from the rear sub to the drill bit guide;

a cylindrical control tube coaxially disposed in between the piston and the sample tube, coupled to and extending forward from the rear sub, the control tube having pressurized fluid inlet means connected to an annular passageway formed between the control tube and the sample tube; and two chambers to help to respectively supply and discharge pressurized fluid into and out of the work chambers: an internal chamber defined by a central recess in the inner surfaces of the piston and a discharge chamber defined by one or more recesses in the inner surface of the outer casing, preferably a single annular recess.

These elements have the following configuration:

the outer surfaces of the sample tube include recessed front-end and rear portions, and a central control portion in between;

the cylindrical control tube comprises a front-end control outer-surface portion and a recessed rear-end outer-surface portion;

the discharge chamber is delimited by the outer surface of the cylinder and the inner surface of the outer casing; and the internal chamber is delimited on the one side by the outer surfaces of the sample tube alone or together with the outer surfaces of the control tube, depending on the position of the piston during the operation of the hammer, and on the other side by the inner surfaces of the piston.

The invention is characterized by the internal chamber being permanently filled with and connected to the source of pressurized fluid through the annular passageway that is formed between the control tube and the sample tube, for supplying pressurized fluid to the front and rear chambers of the hammer. For such purpose, the pressurized fluid flow system of the invention is respectively configured such that a front annular supply passage is formed in the overlap between the front inner sliding surface portion of the piston and the recessed front-end outer surface portion of the sample tube, and a rear annular supply passage is formed in the overlap between the rear inner sliding surface portion of the piston and the recessed rear-end outer surface portion of the control tube.

On the other hand, the discharge chamber is permanently communicated with the bottom of the hole drilled by the hammer for discharging into said hole the pressurized fluid from the front and rear chambers of the hammer.

During the stage where the front chamber is supplied with pressurized fluid, the inflow of pressurized fluid is controlled by the overlap of the central control outer surface portion of the sample tube with the front inner sliding surface portion of the piston. Similarly, during the stage where the rear chamber is supplied with pressurized fluid, the inflow of pressurized fluid is controlled by the overlap of the front-end control outer surface portion of the control tube with the rear inner sliding surface portion of the piston. With this form of control of the inflow to the front and rear chambers a more efficient filling of the front and rear chambers is achieved in every cycle of the hammer and the magnitude of the passive volumes in both chambers is reduced.

Moreover, the flow of pressurized fluid discharged from the front and rear chambers is controlled solely by the overlap or relative position of the outer sliding surfaces of the piston with the inner surface of the cylinder. There is a front set of pressurized fluid discharge through-ports in the cylinder for discharging the pressurized fluid from the front chamber to the discharge chamber, and there is a rear set of pressurized fluid discharge through-ports in the cylinder for discharging the pressurized fluid from the rear chamber to the discharge chamber. However, for channeling the pressurized fluid from the internal chamber to the front and rear chambers of the hammer and from these latter chambers to the discharge chamber, no conduits or passages have been milled in the piston, thus rendering the piston stronger and the hammer cheaper to manufacture.

Furthermore, having the pressurized fluid flow system of the invention a discharge chamber adjacent to the inner surface of the outer casing allows to divert the pressurized fluid flow to the outside of the outer casing through one or more end discharge ports bored in the casing's wall, and therethrough to discharge the pressurized fluid to the peripheral region of the front end of the drill bit.

In a second aspect of the invention, a reverse circulation DTH hammer is provided, characterized by having the improved pressurized fluid flow system that has been described above and by discharging the pressurized fluid from the discharge chamber and out of the outer casing along the sides of the front end portion of the same, through the aforementioned end discharge ports.

Preferably the end discharge ports are connected to respective longitudinal discharge channels formed on the outer surface of the front end portion of the outer casing. Both the end discharge ports and longitudinal discharge channels are covered by a sealing element such as a shroud or outer sealing sleeve, so as to direct the pressurized fluid to the peripheral region of the front end of the drill bit and produce a pressurized fluid flow across the front face of the drill bit for dragging the rock cuttings towards the inside of the continuous central passage formed along the center of the hammer.

To facilitate the understanding of the precedent ideas, hereinafter the invention will be described with reference to the attached drawings.

Figure 1:
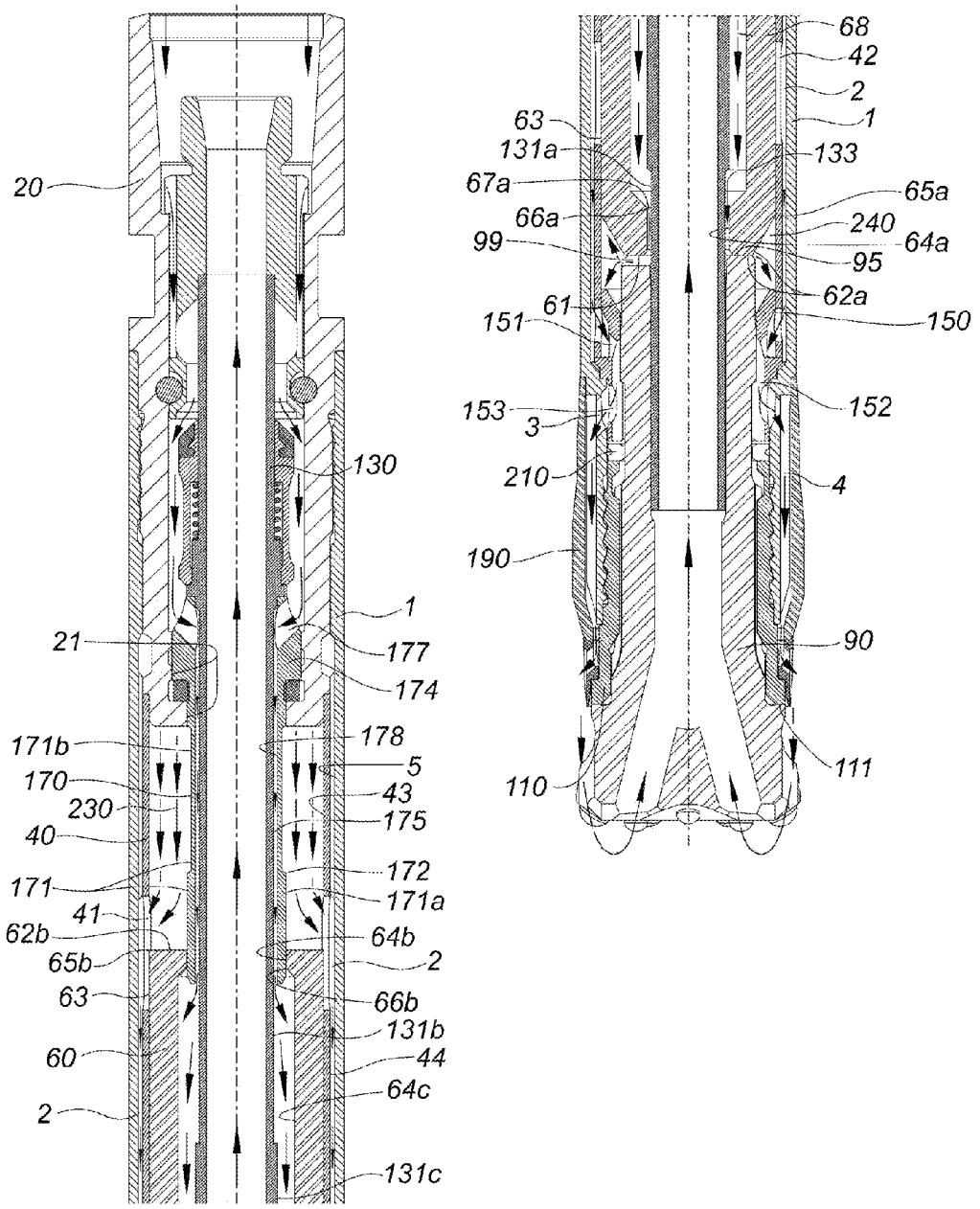
FIG. 1 depicts a longitudinal cross section view of the reverse circulation DTH hammer of the invention specifically showing the disposition of the piston with respect to the outer casing, cylinder, drill bit, control tube and sample tube when the front chamber is being supplied with pressurized fluid and the rear chamber is discharging pressurized fluid to the bottom of the hole.
Figure 2:
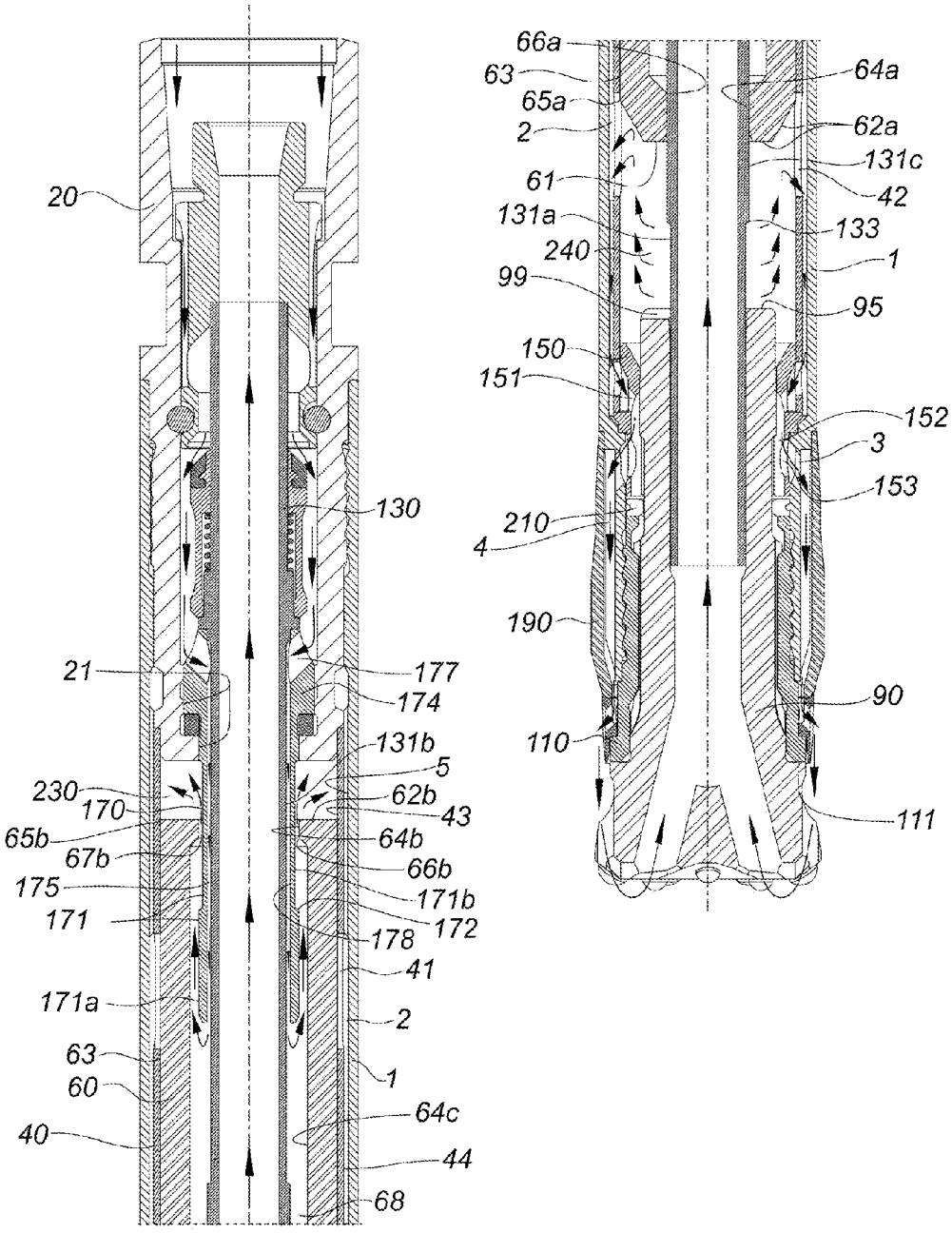
FIG. 2 depicts a longitudinal cross section view of the reverse circulation DTH hammer of the invention specifically showing the disposition of the piston with respect to the outer casing, cylinder, drill bit, control tube and sample tube when the rear chamber is being supplied with pressurized fluid and the front chamber is discharging pressurized fluid to the bottom of the hole.

In these figures, the flow system of the hammer has been depicted with respect to the solution designed under the invention to convey the pressurized fluid to the front chamber and rear chamber, and therefrom to the bottom of the hole, in all the possible modes and states, including the exhaustion of the pressurized fluid to the peripheral region of the front end of the drill bit for flushing the rock cuttings. The direction of the pressurized fluid flow has been indicated by means of arrows.

DETAILED DESCRIPTION OF THE PREFERRED EMBODIMENT OF THE INVENTION (FIGS. 1 to 4)

Referring to FIGS. 1 to 4, a reverse circulation DTH hammer is depicted having the following main components:

a cylindrical outer casing (1);

a rear sub (20) affixed to the rear end of said outer casing (1) for connecting the hammer to the source of pressurized fluid;

a centrally-bored piston (60) slidably and coaxially disposed inside said outer casing (1) and capable of reciprocating due to the change in pressure of the pressurized fluid contained inside of a front chamber (240) and a rear chamber (230) located at opposites ends of the piston (60), the piston (60) having outer sliding surfaces (63), and inner surfaces (64);

a drill bit (90) slidably mounted in the front end of the hammer on a driver sub (110), the driver sub (110) being mounted in the front end of the outer casing (1), the drill bit (90) being aligned with the outer casing (1) by means of a drill bit guide (150) disposed inside said outer casing (1) and limited in its sliding movement by a drill bit retainer (210) and the drill bit supporting face (111) of the driver sub (110); and a sample tube (130) coaxially disposed within the outer casing (1) and extending from the drill bit (90) to the rear sub (20).

According to the pressurized fluid flow system of the invention the centrally-bored piston has outer sliding surfaces (63), a front inner sliding surface portion (64*a*), a rear inner sliding surface portion (64*b*) and a central recess (64*c*) in the inner surfaces (64) of the piston (60); and the sample tube (130) has a central control outer surface portion (131*c*) for interacting with said front inner sliding surface portion (64*a*) of the piston.

Further, a cylinder (40) and a cylindrical control tube (170) are provided, which are respectively disposed coaxially in between the outer casing (1) and the piston (60), and in between the piston (60) and the sample tube (130), the sample tube comprising a recessed rear-end outer surface portion (131*b*) such that an annular passageway (175) is formed in between the sample tube (130) and the control tube (170). Part of the inner surface (5) of the outer casing (1), the drill bit guide (150) and the rear sub (20) provide support for the cylinder (40) while the cylindrical control tube (170) is supported on the front inner guide surfaces (21) of the rear sub (20). The cylindrical control tube (170) has an inner surface (178), a front-end control outer surface portion (171*a*) and a rear-end recessed outer surface portion (171*b*). The cylinder (40) extends from the rear sub (20) to the drill bit guide (150) and has an inner surface (43) and an outer surface 44, and the control tube (170) is coupled by a coupling portion (174) thereof to, and extends forward from, the rear sub (20), having inner surfaces (178) and outer surfaces (171).

Accordingly, the rear chamber (230) of the hammer is delimited by the rear sub (20), the cylinder (40), the control tube (170) and the rear thrust surface (62*b*) of the piston (60). In turn, the front chamber (240) of the hammer is delimited by the drill bit (90), the cylinder (40), the drill bit guide (150), the sample tube (130) and the front thrust surface (62*a*) of the piston (60). The volume of these chambers (230, 240) is variable and depends on the piston's (60) position.

The pressurized fluid flow system of the invention further comprises a discharge chamber (2) that, when the hammer is in operation, is in permanent fluid communication with the bottom of the hole drilled by the hammer for discharging pressurized fluid from the front chamber (240) and from the rear chamber (230) to the front of the hammer and therefrom to the bottom of the hole. In the exemplary embodiment depicted in the figures the discharge chamber (2) is composed of a central annular space (2*a*) in the middle and a set of discharge passageways (2*b*, 2*c*) extending from each of the ends of the central annular space (2*a*), both the annular space (2*a*) and passageways (2*b*, 2*c*) being defined by recesses in the inner surface (5) of the outer casing (1) and internally delimited by the cylinder (40). It should be understood that the discharge chamber (2) could also have other configurations such as being formed by a single annular recess in the inner surface (5) of the outer casing (1).

A front set of pressurized fluid discharge through-ports (42) and a rear set of pressurized fluid discharge through-ports (41) are provided in the cylinder (40) for respectively channelling the pressurized fluid out of the front and rear chambers (240, 230) and into the discharge chamber (2), so the flow of pressurized fluid discharged from the front and rear chambers is controlled solely by the overlap or relative position of the outer sliding surfaces of the piston with the inner surface of the cylinder.

The pressurized fluid flow system of the invention also has an internal chamber (68) for supplying pressurized fluid to the front chamber (240) and to the rear chamber (230). In the embodiment depicted in the figures, the internal chamber (68) is defined by the central recess (64*c*) in the inner surfaces (64) of the piston (60), externally delimited by said central recess (64*c*), and it is internally delimited by either outer surfaces (131) of the sample tube (130) alone (see FIG. 1) or the outer surfaces (131) of the sample tube (130) together with the outer surfaces (171) of the control tube (170) (see FIG. 2), depending on the position of the piston during the operation of the hammer.

According to a preferred embodiment of the invention as depicted in the figures, the control tube (170) has at its rear end thereof a set of inlet ports (177) that allows the pressurized fluid to flow from the rear sub (20) to the internal chamber (68), through the annular passageway (175) formed between the inner surface (178) of the control tube (170) and the recessed rear-end outer surface portion (131*b*) of the sample tube (130).

When the hammer is in operation, the internal chamber (68) is in permanent fluid communication with the source of pressurized fluid and filled with said pressurized fluid. A front annular supply passage (67*a*) is formed between the front inner sliding surface portion (64*a*) of the piston (60) and the recessed front-end outer surface portion (131*a*) of the sample tube (130), and a rear annular supply passage (67*b*) is formed between the rear inner sliding surface portion (64*b*) of the piston (60) and the rear-end recessed outer surface portion (171*b*) of the control tube (170) as the piston (60) reciprocates, to respectively supply pressurized fluid to the front and rear chambers (240, 230) of the hammer. The inflow of pressurized fluid to the front and rear chambers (240, 230) is thereby controlled respectively by the overlap of the front inner sliding surface portion (64*a*) of the piston (60) with the central control outer surface portion (131*c*) of the sample tube (130) and by the overlap of the rear inner sliding surface portion (64*b*) of the piston (60) with the front-end control outer surface portion (171*a*) of the cylindrical control tube (170).

Further, the outer casing (1) of the pressurized fluid flow system of the invention has at its front end portion one or more end discharge ports (3) connected to respective longitudinal discharge channels (4) milled on the outer surface of the front end portion of the outer casing, both the end discharge ports (3) and longitudinal discharge channels (4) having the function of conveying the flow of pressurized fluid received in the discharge chamber (2) from the front and rear chambers (240, 230) of the hammer, to the outside of the outer casing (1) and therefrom to the peripheral region of the front end of the drill bit (90). The end discharge ports (3) and longitudinal discharge channels (4) are covered by a sealing element such as a shroud or a cylindrical outer sealing sleeve (190).

Control of the State of the Front Chamber (240)

When in the hammer cycle the impact face (61) of the piston (60) is in contact with the impact face (95) of the drill bit (90) and the drill bit (90) is at the rearmost point of its stroke, i.e. the hammer is at its impact position (see FIG. 1), the front chamber (240) is fluidly communicated with the internal chamber (68) through the front annular supply passage (67*a*) formed in between the front inner sliding surface portion (64*a*) of the piston (60) and the recessed front-end outer surface portion (131*a*) of the sample tube (130) and through a set of flow enhancing passages (99) milled on the impact face (95) of the drill bit (90). In this way, the pressurized fluid can flow from the internal chamber (68) toward the front chamber (240) and begin the rearward movement of the piston (60).

The inflow of pressurized fluid into the front chamber (240) will stop when the piston (60) has traveled in the front end to rear end direction of its stroke until the point where the front pressurized fluid supply edge (66*a*) of the piston (60) reaches the front pressurized fluid supply edge (133) of the sample tube (130). As the movement of the piston (60) continues further in the front end to rear end direction of its stroke, a point will be reached where the front pressurized fluid discharge edge (65*a*) of the piston (60) matches the front limit of the front set of pressurized fluid discharge through-ports (42) of the cylinder (40). As the movement of the piston (60) continues even further, the front chamber (240) of the hammer will become fluidly communicated with the discharge chamber (2) through the front set of pressurized fluid discharge through-ports (42) of the cylinder (40) (see FIG. 2). In this way, the pressurized fluid contained inside the front chamber (240) will be discharged into the discharge chamber (2) and from the discharge chamber (2) it is able to freely flow out of the outer casing (1). According to the exemplary embodiment shown in the figures, the pressurized fluid from the discharge chamber (2) is discharged through pressurized fluid discharge passageways (151), discharge grooves (152) and discharge ports (153) of the drill bit guide (150), and therethrough to the end discharge ports (3) of the outer casing (1). From said ports (3) the pressurized fluid is then directed to the peripheral region of the front end of the drill bit (90), through the longitudinal discharge channels (4) of the outer casing (1). These ports (3) and channels (4) are covered by the shroud or outer sealing sleeve (190).

Control of the State of the Rear Chamber (230)

When in the hammer cycle the impact face (61) of the piston (60) is in contact with the impact face (95) of the drill bit (90) and the drill bit (90) is at the rearmost point of its stroke, i.e. the hammer is at impact position (see FIG. 1), the rear chamber (230) is in direct fluid communication with the discharge chamber (2) through the rear set of pressurized fluid discharge through-ports (41) of the cylinder (40). In this way the pressurized fluid contained inside the rear chamber (230) is able to freely flow to the discharge chamber (2) and from the discharge chamber (2) it is able to freely flow out of the outer casing (1) through the pressurized fluid discharge passageways (151), discharge grooves (152) and discharge ports (153) of the drill bit guide (150), and through the end discharge ports (3) of the outer casing (1), from where it is directed to the peripheral region of the front end of the drill bit (90), through the longitudinal discharge channels (4) of the outer casing (1). These ports (3) and channels (4) are covered by the shroud or outer sealing sleeve (190).

The outflow of pressurized fluid from the rear chamber (230) will stop when the piston (60) has traveled in the front end to rear end direction of its stroke until the rear pressurized fluid discharge edge (65*b*) of the piston (60) reaches the rear limit of the rear set of pressurized fluid discharge through-ports (41) of the cylinder (40). As the movement of the piston (60) continues further in the front end to rear end direction of its stroke, a point will be reached where the rear pressurized fluid supply edge (66*b*) of the piston (60) matches the rear pressurized fluid supply edge (172) of the control tube (170). As the movement of the piston (60) continues even further, the rear chamber (230) of the hammer becomes fluidly communicated with the internal chamber (68) of the piston (60) through the rear annular supply passage (67*b*) formed in between the rear inner sliding surface portion (64*b*) of the piston (60) and the rear-end recessed outer surface portion (171*b*) of the control tube (170) (see FIG. 2). In this way, the rear chamber (230) will be filled with pressurized fluid coming from the internal chamber (68).

Flushing Mode Operation

Figure 3:
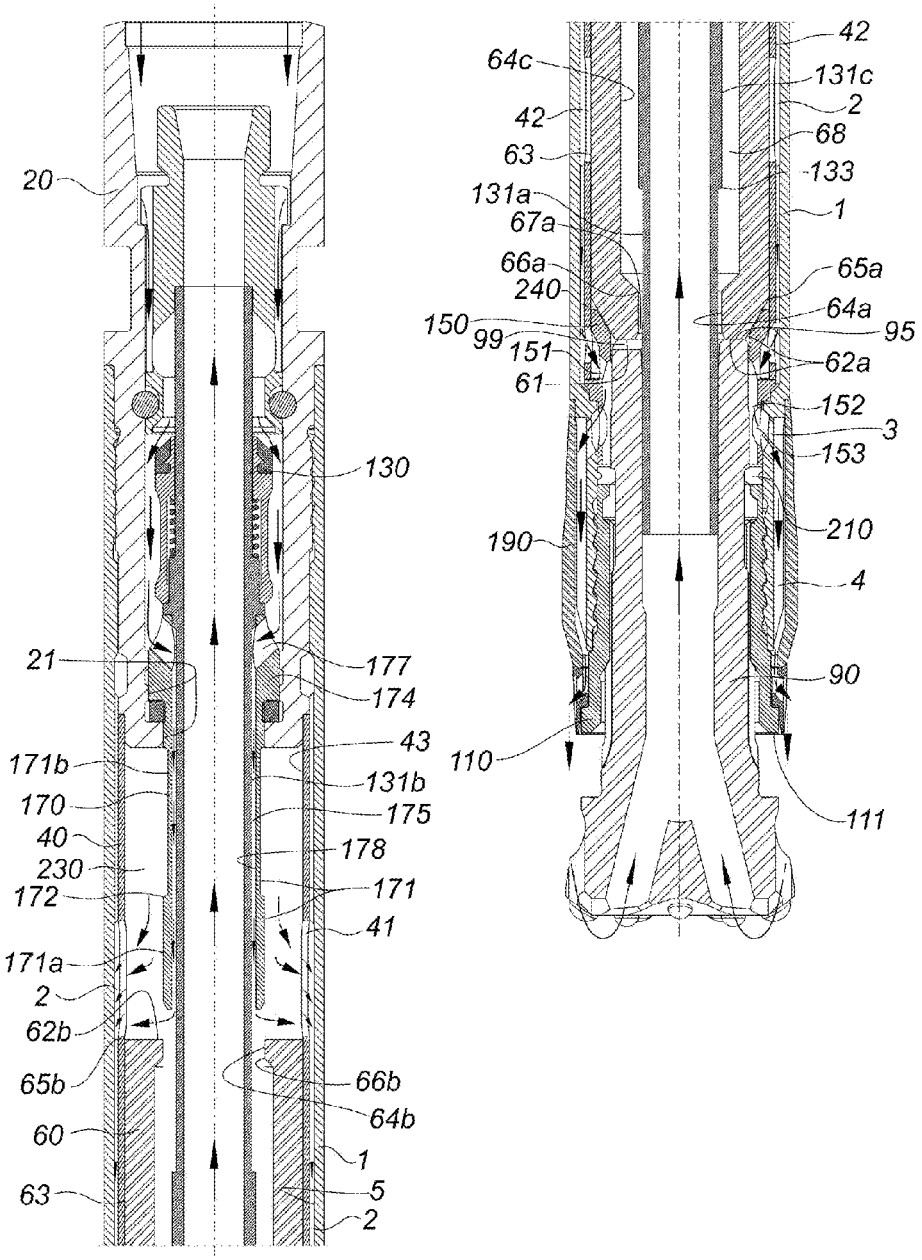
FIG. 3 depicts a longitudinal cross section view of the reverse circulation DTH hammer of the invention specifically showing the disposition of the piston and the drill bit with respect to the outer casing, cylinder, control tube and sample tube when the hammer is in flushing mode.
Figure 4:
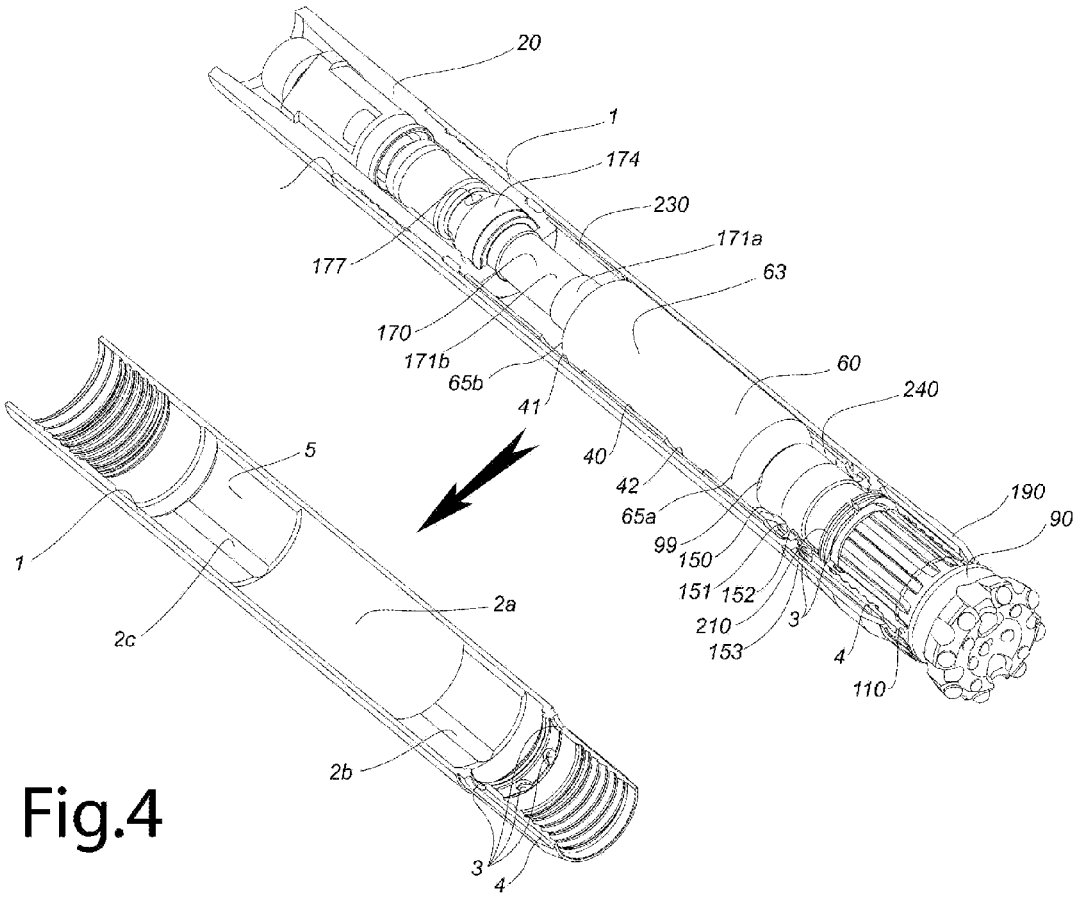
FIG. 4 depicts an isometric view of the reverse circulation DTH hammer of the invention with a cut-out outer casing for showing the disposition of the inner parts of the hammer when the front chamber is being supplied with pressurized fluid and the rear chamber is discharging pressurized fluid to the bottom of the hole.

In the flushing mode of the hammer depicted by FIG. 3, i.e. when the percussion of the hammer stops, the impact face (61) of the piston (60) rests on the impact face (95) of the drill bit (90), and the pressurized fluid is conveyed directly to the peripheral region of the front end of the drill bit (90) through the following pathway: into the rear chamber (230), through the rear sub (20), through the set of pressurized fluid inlet ports (177) of the control tube (170), through the annular passageway (175) formed in between the inner surface (178) of control tube (170) and the recessed rear-end outer surface portion (131*b*) of the sample tube (130), to the rear chamber (230); and from the rear chamber (230) to the discharge chamber (2) through the rear set of pressurized fluid discharge through-ports (41) of the cylinder (40). From the discharge chamber (2) the pressurized fluid is able to flow freely to the outside of the outer casing (1) through the pressurized fluid discharge passageways (151), discharge grooves (152) and discharge ports (153) of the drill bit guide (150), and through the end discharge ports (3) of the outer casing (1), from where it is directed to the peripheral region of the front end of the drill bit (90), through the longitudinal discharge channels (4) of the outer casing (1). These ports (3) and channels (4) are covered by the shroud or outer sealing sleeve (190).

Pressurized fluid that flows into the front chamber (240) from the internal chamber (68) of the piston (60), is then conveyed to the outside of the outer casing (1) through the pressurized fluid discharge grooves (152) and discharge ports (153) of the drill bit guide (150) and through the set of end discharge ports (3) of the outer casing (1).

The invention claimed is:

1. A pressurized fluid flow system for a reverse circulation Down-The-Hole hammer, wherein the hammer comprises the following main components:

a cylindrical outer casing having a front end and a rear end;

a rear sub affixed to the rear end of said outer casing for connecting the hammer to the source of pressurized fluid;

a centrally-bored piston slidably and coaxially disposed inside said outer casing and capable of reciprocating due to the change in pressure of the pressurized fluid contained inside of a front chamber and a rear chamber located at opposites ends of the piston, the piston having outer sliding surfaces and inner surfaces;

a drill bit slidably mounted in the front end of the hammer on a driver sub mounted in the front end of the outer casing, the drill bit being aligned with the outer by means of a drill bit guide disposed inside said outer casing; and a sample tube coaxially disposed within the outer casing, passing through the central bore of the piston and extending from the drill bit to the rear sub, the sample tube having inner surfaces and outer surfaces;

wherein the pressurized fluid flow system of the invention comprises:

a cylinder coaxially disposed in between the outer casing and the piston, the cylinder extending from the rear sub to the drill bit guide and having an inner surface and an outer surface;

a cylindrical control tube coaxially disposed in between the piston and the sample tube, the cylindrical control tube extending forward from the rear sub to which it is coupled by a coupling portion thereof and having inner surfaces and outer surfaces;

a discharge chamber, defined by one or more recesses in the inner surface of the outer casing and internally delimited by the cylinder, wherein the discharge chamber is in permanent fluid communication with the bottom of the hole for discharging the pressurized fluid from the front and rear chambers; and an internal chamber formed in a central recess made in the inner surfaces of the piston and delimited by the outer surfaces of the sample tube alone or together with the outer surfaces of the control tube, depending on the position of the piston during the operation of the hammer, wherein the internal chamber is in permanent fluid communication with the source of pressurized fluid for supplying said pressurized fluid to the front and rear chambers;

wherein the cylinder has a front set of pressurized fluid discharge through-ports and a rear set of pressurized fluid discharge through-ports for respectively channeling the pressurized fluid out of the front and rear chambers and into the discharge chamber;

wherein the control tube has at its coupling portion pressurized fluid inlet means connected to an annular passageway formed between the control tube and the sample tube for allowing the pressurized fluid to flow from the rear sub to the internal chamber;

wherein the sample tube comprises a recessed front-end outer surface portion that forms a front annular supply passage with the inner surfaces of the piston for channeling the flow of pressurized fluid into the front chamber;

wherein the control tube comprises a rear-end recessed outer surface portion for creating a rear annular supply passage between the inner surfaces of the piston and said rear-end recessed outer surface portion of the control tube for channeling the flow of pressurized fluid into the rear chamber;

whereby the flow of pressurized fluid discharged from the front and rear chambers is controlled solely by the overlap or relative position of the outer sliding surfaces of the piston with the inner surface of the cylinder, while the inflow of pressurized fluid to the front and rear chambers is controlled by the overlap of the inner surfaces of the piston with the outer surfaces of the cylindrical control tube and the outer surfaces portion of the sample tube.

2. The pressurized fluid flow system of claim 1, wherein the inner surfaces of the piston are divided into a front inner sliding surface portion and a rear inner sliding surface portion separated by the central recess;

wherein the sample tube further comprises a central control outer surface portion located forward of the control tube and extending until the recessed front-end outer surface portion for interacting with said front inner sliding surface portion of the piston in allowing or blocking the flow of pressurized fluid into the front chamber during the operation of the hammer.

3. The pressurized fluid flow system of claim 2, wherein the sample tube further comprises a rear recessed outer surface portion extending from the pressurized fluid inlet means of the control tube until said central control outer surface portion, thereby defining the annular passageway together with said inner surfaces of the cylindrical control tube.

4. The pressurized fluid flow system of claim 1, wherein the control tube further comprises a front-end control outer surface portion for interacting with the rear inner sliding surface portion of the piston in allowing or blocking the flow of pressurized fluid into the rear chamber during the operation of the hammer.

5. The pressurized fluid flow system of claim 1, wherein the set of pressurized fluid inlet means of the control tube connected with the annular passageway formed between the control tube and the sample tube, are comprised of a set of inlet ports.

6. A reverse circulation DTH hammer, wherein the hammer comprises:

the pressurized fluid flow system of claim 1; and one or more end discharge ports connected to respective longitudinal discharge channels formed on the outer surface of the front end of the outer casing;

wherein both the end discharge ports and the longitudinal discharge channels have the function of conveying the flow of pressurized fluid from the discharge chamber to the outside of the outer casing and along the sides of the front-end of the casing and therefrom to the peripheral region of the front end of the drill bit.

7. The reverse circulation DTH hammer of claim 6, wherein the end discharge ports and the longitudinal discharge channels are covered by a sealing element such as a shroud or a cylindrical outer sealing sleeve for directing the pressurized fluid to said peripheral region of the front end of the drill bit and producing a pressurized fluid flow across the front face of the drill bit for dragging the rock cuttings towards the sample tube.

* * * * *